US005355698A

United States Patent [19]

Edmark

[11] Patent Number: 5,355,698

[45] Date of Patent: Oct. 18, 1994

[54] INTERCHANGEABLE DECORATIVE ORNAMENT

[76] Inventor: Tomima L. Edmark, 5335 S. Dentwood Dr., Dallas, Dallas County, Tex. 75220

[21] Appl. No.: 71,479

[22] Filed: Jun. 4, 1993

[51] Int. Cl.[5] ..... A44C 17/02

[52] U.S. Cl. ..... 63/29.1; 63/2

[58] Field of Search ..... 63/29.1, 29.2, 1.1, 63/12, 13, 2; D11/40, 47

[56] References Cited

U.S. PATENT DOCUMENTS

| | | | |
|---|---|---|---|
| 3,348,388 | 10/1967 | Elliott . | |
| 3,441,032 | 4/1969 | Barrett . | |
| 3,639,949 | 2/1972 | Beck | 63/29.1 |
| 3,913,184 | 10/1975 | Hanan | 63/29.1 |
| 4,195,492 | 4/1980 | Johnson | 63/29.1 |
| 4,488,415 | 12/1984 | Jenkins | 63/29.1 |
| 4,507,344 | 3/1985 | Baughman . | |
| 4,522,215 | 6/1985 | Verducci . | |
| 4,608,838 | 9/1986 | Gardner . | |
| 4,665,595 | 5/1987 | Voit et al. . | |
| 4,793,155 | 12/1988 | Law . | |
| 4,899,556 | 2/1990 | Ford . | |
| 4,939,913 | 7/1990 | Scungio et al. . | |
| 4,982,581 | 1/1991 | Furuyama | 63/29.1 |
| 5,165,257 | 11/1992 | Corenblith . | |

*Primary Examiner*—Michael Milano
*Attorney, Agent, or Firm*—Baker & Botts

[57] ABSTRACT

The present invention provides an interchangeable decorative ornament (10) comprising a setting (12), at least one decorative piece (14), a coupler (16), and a fastener (18). The coupler (16) is formed on setting (12) and decorative piece (14). Decorative piece (14) may be removably coupled to the setting (12) by coupler (16). Interchangeable decorative ornament (10) may be displayed on a user by fastener (18).

16 Claims, 1 Drawing Sheet

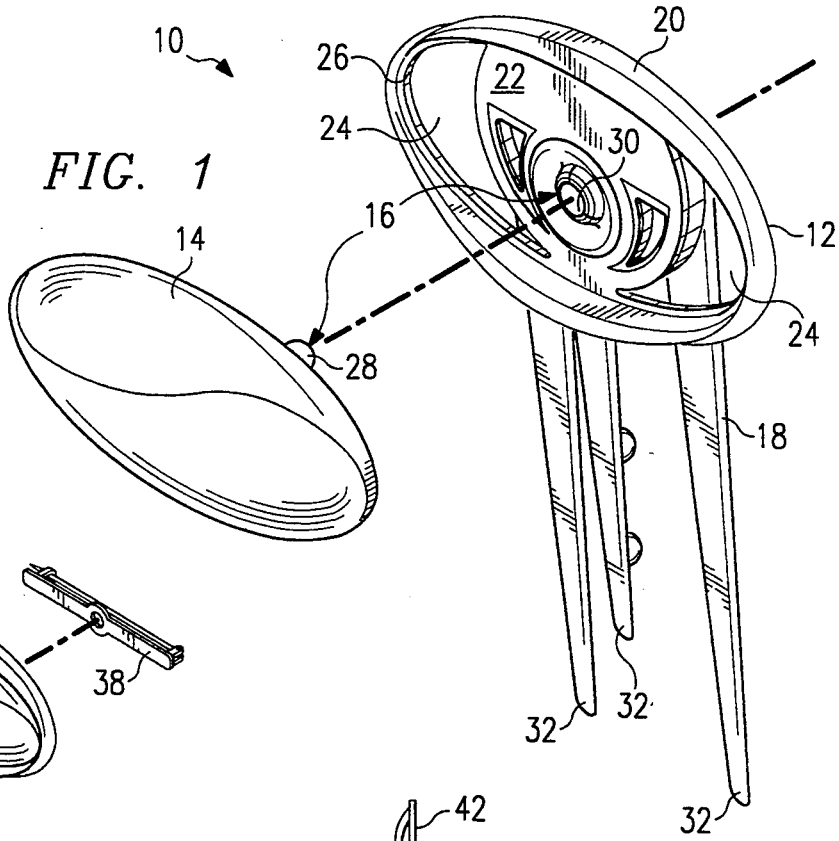
FIG. 1
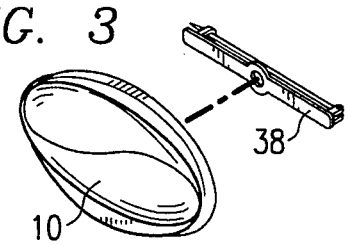
FIG. 3
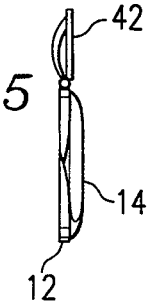
FIG. 5
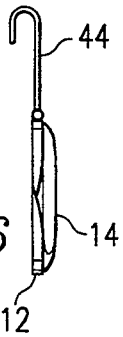
FIG. 6
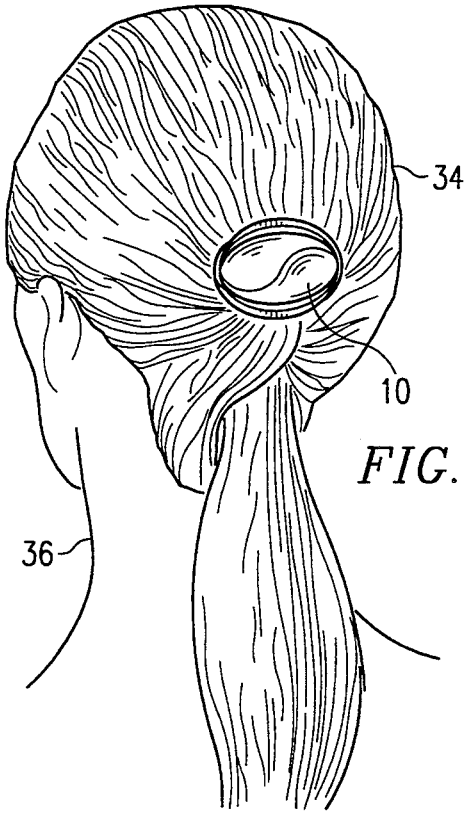
FIG. 2
FIG. 4
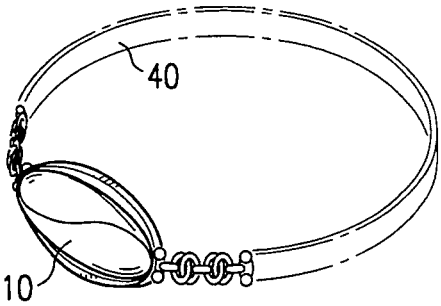

INTERCHANGEABLE DECORATIVE ORNAMENT

TECHNICAL FIELD OF THE INVENTION

This invention relates in general to the field of decorative ornaments, and more particularly to an interchangeable decorative ornament.

BACKGROUND OF THE INVENTION

It is a common practice for people to spice up an outfit by wearing various decorative ornaments or fashion accessories. Indeed, various industries have developed that produce nothing but fashion accessories. Most department stores have entire departments devoted to the display and sale of these fashion accessories.

Certain rules of fashion dictate that a particular fashion accessory will not go with every outfit. Some colors and styles just do not look acceptable together. Therefore, a person may need to purchase many different fashion accessories to provide an appropriate accessory for each outfit in the person's wardrobe. If the wardrobe is at all large, this could get very expensive.

A prior solution provides for modular fashion accessories wherein a decorative piece is fastened to a setting by a magnet system. This allows an individual to create enough fashion accessories to go with each outfit in a wardrobe by purchasing just a single setting and a number of decorative pieces. However, there are several drawbacks to this prior solution.

First, the prior solution may provide a very heavy fashion accessory. The weight of the fashion accessory depends on how large a magnet is used to secure the decorative piece to the setting. A lighter fashion accessory may be achieved by using a smaller magnet. However, the tradeoff in using a smaller magnet is a corresponding loss in attractive force created by the magnet. If a light magnet is used, the decorative piece may be easily dislodged and lost because the magnet may be too small to provide a strong attractive force. Finally, the fashion accessory may outlast the magnet because the magnet may wear out over time.

Therefore, a need has arisen for an interchangeable decorative ornament which provides a light-weight, tight locking system that does not wear out over time.

SUMMARY OF THE INVENTION

In accordance with the present invention, an interchangeable decorative ornament is provided which substantially eliminates or reduces the disadvantages and problems associated with prior systems. More particularly, the present invention provides an interchangeable decorative ornament comprising a setting and at least one decorative piece. A means for removably coupling the decorative piece to the setting is coupled to the setting and the decorative piece. Finally, a means for displaying the interchangeable decorative ornament is coupled to the setting.

It is a technical advantage of the present invention to provide an interchangeable decorative ornament. The appearance of the interchangeable decorative ornament may be quickly and easily changed by removing a first decorative piece and inserting a second decorative piece. In this manner a single decorative ornament may be used to embellish many different outfits.

It is another technical advantage of the present invention to provide an interchangeable decorative ornament that comprises a coupling means that is both light in weight and able to securely couple the decorative piece to the setting. Furthermore, the coupling means may be used for a long period of time without wearing out.

BRIEF DESCRIPTION OF THE DRAWINGS

For a more complete understanding of the present invention and the advantages thereof, reference is now made to the following description taken in conjunction with the accompanying drawings in which like reference number indicates like features and wherein:

FIG. 1 an exploded perspective view of one embodiment of an interchangeable decorative ornament constructed according to the teachings of the present invention;

FIG. 2 view of the interchangeable decorative ornament of FIG. 1 in a user's hair;

FIG. 3 is a view of another embodiment of an interchangeable decorative ornament having a pin and constructed according to the teachings of the present invention;

FIG. 4 is a view of another embodiment of an interchangeable decorative ornament having a chain and constructed according to the teachings of the present invention;

FIG. 5 is a view of another embodiment of an interchangeable decorative ornament having a clip and constructed according to the teaching of the present invention; and FIG. 6 is a view of another embodiment of an interchangeable decorative ornament having a clasp and constructed according to the teachings of the present invention.

DETAILED DESCRIPTION OF THE INVENTION

FIG. 1 is an exploded perspective view of an embodiment of an interchangeable decorative ornament indicated generally at 10 and constructed according to the teachings of the present invention. Ornament 10 comprises a setting 12, at least one decorative piece 14, a coupler 16, and a fastener 18.

Setting 12 comprises a frame 20 and a base 22. A decorative piece 14 may be removably coupled to setting 12 by coupler 16. Setting 12 may, for example, comprise an oval shape. Alternatively, setting 12 may comprise another appropriate shape to accommodate a specific shape of a decorative piece 14. Setting 12 may comprise, for example, a rigid plastic material or other suitable material for securing a decorative piece 14 in place. Frame 20 may comprise an edge 26. Edge 26 may be beveled to secure a decorative piece 14 in place in setting 12. Base 22 is coupled to frame 20 to provide at least one opening 24 between base 22 and frame 20. Opening 24 allows decorative piece 14 to be separated from setting 12 by pushing on decorative piece 14 through opening 24. Setting 12 may comprise two openings 24 as shown in FIG. 1 or another appropriate number of openings.

Decorative piece 14 may comprise a molded plastic decorative body. Alternatively, decorative piece 14 may comprise a jewel, or another appropriate decorative item capable of being coupled to setting 12. For example, decorative piece 14 may comprise a pearl for coupling to a setting 12 sized to receive a pearl. As shown in FIG. 1, decorative piece 14 comprises a molded plastic body having a decorative design formed thereon. It should be understood that decorative piece 14 has been described as molded plastic in the preferred embodiment, however, decorative piece 14 can be constructed of any material; and, by way of example and not limitation, some decorative materials include precious and semi-precious metals, jewels, wood, bone, ivory, shell or the like.

Coupler 16 is coupled to setting 12 and decorative piece 14. As shown in FIG. 1, coupler 16 comprises a snap having a male coupler 28 and a female coupler 30. As shown, male coupler 28 is formed on decorative piece 14 and female coupler 30 is formed on base 22 of setting 12. Alternatively, male coupler 28 may be formed on base 22 of setting 12 and female coupler 30 may be formed on decorative piece 14. Finally, other means for removably coupling two parts together that are well known to a person of ordinary skill in the art may be used in place of male and female couplers 28 and 30. For example, coupler 16 may comprise a threaded screw and matching threaded opening, a dowel and pin assembly, a lock and key assembly, a post and clasp assembly, a hook and loop fastener such as that produced by the Velcro Company, or any other coupling mechanism known to those skilled in the art.

A decorative piece 14 coupled to setting 12 may be displayed by using fastener 18. As shown in FIG. 1, fastener 18 comprises three pins 32. In this manner, interchangeable decorative ornament 10 comprises a hair ornament. Pins 32 may be inserted into the hair 34 of a user 36. Thereby, interchangeable decorative ornament 10 may be appropriately displayed in hair 34 of user 36 as shown in FIG. 2. Fastener 18 may also comprise a pin 38 of the type shown in FIG. 3. With pin 38, interchangeable decorative ornament 10 may be appropriately displayed as a brooch or other type of decorative pin. Furthermore, fastener 18 may comprise a chain 40 as shown in FIG. 4. As such, interchangeable decorative ornament 10 may be appropriately displayed as a necklace or bracelet by simply varying the size and length of chain 40. Finally, fastener 18 may comprise other fasteners well known to a person of ordinary skill in the art. For example, fastener 18 may also comprise a clasp 42 as shown in FIG. 5 or a clip 44 as shown in FIG. 6. In this manner, interchangeable decorative ornament 10 may comprise a pierced earring, as shown in FIG. 6, or a clip-on earring, as shown in FIG. 5.

Although the present invention has been described in detail it should be understood that various changes, substitutions and alterations can be made hereto without departing from the spirit and scope of the invention as defined by the appended claims.

What is claimed is:

1. An interchangeable decorative ornament, comprising:
- a setting comprising a frame and a base;
- at least one decorative piece;
- means, coupled to said base and said decorative piece, for removably coupling said decorative piece to said setting;
- said frame having an edge adjacent to and securing said decorative piece in place in said setting;
- said base operable to receive said decorative piece and coupled to said frame such that at least one unobstructed opening is formed between said base and said frame to allow said decorative piece to be separated from said setting; and
- means, coupled to said setting, for displaying the interchangeable decorative ornament.

2. The interchangeable decorative ornament of claim 1, wherein said decorative piece comprises a molded plastic decorative body.

3. The interchangeable decorative ornament of claim 1, wherein said decorative piece comprises a jewel.

4. The interchangeable decorative ornament of claim 1, wherein said coupling means comprises:
- a male coupler formed on said base; and
- a female coupler formed on said decorative piece.

5. The interchangeable decorative ornament of claim 1, wherein said coupling means comprises:
- a male coupler formed on said decorative piece; and
- a female coupler formed on said base.

6. The interchangeable decorative ornament of claim 1, wherein said means for displaying comprises a pin disposed on said setting.

7. The interchangeable decorative ornament of claim 1, wherein said means for displaying comprises a clasp disposed on said setting.

8. The interchangeable decorative ornament of claim 1, wherein said means for displaying comprises a clip disposed on said setting.

9. The interchangeable decorative ornament of claim 1, wherein said means for displaying comprises a chain coupled to said setting.

10. A setting for displaying a decorative piece in an interchangeable decorative ornament, comprising:
- a base operable to receive the decorative piece;
- means, coupled to said base, for removably coupling said decorative piece to the setting;
- a frame having an edge adjacent to and securing the decorative piece in place in the setting wherein said base is coupled to said frame such that at least one unobstructed opening is formed between said base and said frame to allow the decorative piece to be separated from the setting; and
- means, coupled to said base, for displaying the interchangeable decorative ornament.

11. The setting of claim 10; wherein said coupling means comprises:
- a male coupler formed on said base; and
- a female coupler formed on the decorative piece.

12. The setting of claim 10, wherein said coupling means comprises:
- a male coupler formed on the decorative piece; and
- a female coupler formed on said base.

13. The setting of claim 10, wherein said means for displaying comprises a pin disposed on said base.

14. The setting of claim 10, wherein said means for displaying comprises a clasp disposed on said base.

15. The setting of claim 10, wherein said means for displaying comprises a clip disposed on said base.

16. The setting of claim 10, wherein said means for displaying comprises a chain coupled to said base.

* * * * *